US010317089B2

(12) United States Patent
Nuessler

(10) Patent No.: US 10,317,089 B2
(45) Date of Patent: Jun. 11, 2019

(54) DOMESTIC APPLIANCE

(71) Applicant: BSH HAUSGERAETE GMBH, Munich (DE)

(72) Inventor: Gerhard Nuessler, Munich (DE)

(73) Assignee: BSH Hausgeraete GmbH, Munich (DE)

( * ) Notice: Subject to any disclaimer, the term of this patent is extended or adjusted under 35 U.S.C. 154(b) by 162 days.

(21) Appl. No.: 15/037,480

(22) PCT Filed: Nov. 20, 2014

(86) PCT No.: PCT/EP2014/075159
§ 371 (c)(1),
(2) Date: May 18, 2016

(87) PCT Pub. No.: WO2015/075126
PCT Pub. Date: May 28, 2015

(65) Prior Publication Data

US 2016/0281994 A1 Sep. 29, 2016

(30) Foreign Application Priority Data

Nov. 22, 2013 (DE) ..... 10 2013 223 934

(51) Int. Cl.
*F24C 7/08* (2006.01)
*G08C 17/02* (2006.01)
(Continued)

(52) U.S. Cl.
CPC ..... *F24C 7/08* (2013.01); *A47L 15/4293* (2013.01); *D06F 39/005* (2013.01); *F24C 7/081* (2013.01);
(Continued)

(58) Field of Classification Search
CPC .. F24C 7/08; F24C 7/081; F24C 7/082; F24C 7/085; F24C 5/16; G08C 2201/91;
(Continued)

(56) References Cited

U.S. PATENT DOCUMENTS 6,587,739 B1 * 7/2003 Abrams ..... G05B 15/02 340/12.32
6,993,615 B2 * 1/2006 Falcon ..... G06F 1/1626 381/86
(Continued)

FOREIGN PATENT DOCUMENTS

CN 1511393 A 7/2004
DE 19757305 A1 6/1999
(Continued)

*Primary Examiner* — Reginald Alexander
(74) *Attorney, Agent, or Firm* — Laurence A. Greenberg; Werner H. Stemer; Ralph E. Locher

(57) ABSTRACT

A domestic appliance includes at least one electrically actuated device-type-specific device component executing an operating function characteristic of the type of domestic appliance, a control apparatus actuating the component, and an input electrically connected to the control apparatus and having a display, at least one programmable input and at least one switch electrically contacted to switch a main function of the appliance being characteristic of different types of appliances. The input apparatus has a programmable controller storing at least two programs differently configured to actuate a corresponding number of different types of appliances. The programs are each configured for device-type-specific communication between the at least one programmable input and the control apparatus and to activate only that program corresponding to the type of appliance connected to the input apparatus based on the type of appliance having the control apparatus thereof connected to the input apparatus.

13 Claims, 2 Drawing Sheets

(51) Int. Cl.

| | |
|---|---|
| ***D06F 39/00*** | (2006.01) |
| ***F25D 29/00*** | (2006.01) |
| ***A47L 15/42*** | (2006.01) |
| *D06F 33/02* | (2006.01) |

(52) U.S. Cl.
CPC ..... *F24C 7/082* (2013.01); *F24C 7/085* (2013.01); *F25D 29/005* (2013.01); *G08C 17/02* (2013.01); *D06F 33/02* (2013.01); *D06F 2214/00* (2013.01); *F25D 2400/36* (2013.01); *F25D 2600/06* (2013.01); *G08C 2201/91* (2013.01)

(58) Field of Classification Search
CPC ..... G08C 17/00; G08C 17/02; H04B 3/54; G04B 19/0423
USPC ..... 99/325, 326, 331, 334, 340
See application file for complete search history.

(56) References Cited

U.S. PATENT DOCUMENTS

| | | | | |
|---|---|---|---|---|
| 7,133,739 | B2 * | 11/2006 | Williamson | H04N 21/25891 219/414 |
| 7,326,888 | B2 * | 2/2008 | Chun | F24C 7/08 219/412 |
| 7,356,459 | B2 | 4/2008 | Bergemann et al. | |
| 7,363,031 | B1 | 4/2008 | Aisa | |
| 9,007,184 | B2 * | 4/2015 | Ehrensberger | F24C 15/2021 340/12.23 |
| 2004/0039457 | A1 | 2/2004 | Boldt et al. | |
| 2004/0046454 | A1 * | 3/2004 | Kang | H02J 3/14 307/38 |
| 2007/0157642 | A1 | 7/2007 | Ferragut et al. | |
| 2008/0105134 | A1 * | 5/2008 | Elston, III | D06F 33/02 99/325 |
| 2009/0118848 | A1 * | 5/2009 | Santinato | A47L 15/4293 700/90 |
| 2010/0243800 | A1 | 9/2010 | Koschberg et al. | |

FOREIGN PATENT DOCUMENTS

| | | | |
|---|---|---|---|
| DE | 101172292 | A1 | 10/2002 |
| DE | 60214672 | T2 | 9/2007 |
| DE | 102008064119 | A1 | 7/2010 |
| DE | 102009002774 | A1 | 11/2010 |
| DE | 102010039942 | A1 | 3/2012 |
| DE | 102010040034 | A1 | 4/2012 |
| DE | 102010063948 | A1 | 6/2012 |
| WO | 0128068 | A1 | 4/2001 |

* cited by examiner

DOMESTIC APPLIANCE

BACKGROUND OF THE INVENTION

Field of the Invention

The invention relates to a domestic appliance having at least one electrically actuated device-type-specific device component which is designed to execute an operating function which is characteristic of the type of domestic appliance and having a control apparatus which is designed to actuate the device-type-specific device component.

DE 10 2009 002 774 A1 discloses a portable operating unit for operating a domestic appliance comprising at least one docking means for docking to the domestic appliance, an identification means for identifying the domestic appliance and a configuration means for the configuration thereof for operating said domestic appliance.

BRIEF SUMMARY OF THE INVENTION

The object of the invention is to provide a domestic appliance having an input apparatus which is able to be produced cost-effectively.

The object of the invention is achieved by a domestic appliance having at least one electrically actuated device-type-specific device component which is designed to execute an operating function which is characteristic of the type of domestic appliance, having a control apparatus which is designed to actuate the device-type-specific device component and having an input apparatus which is electrically connected to the control apparatus and which has a display means, at least one programmable input means and also at least one switch with which electrical contact is made in order to switch a main function of the domestic appliance, which main function is characteristic of at least two different types of domestic appliance, and the input apparatus further has a programmable control device in which at least two programs, which are differently designed to actuate a corresponding number of different types of domestic appliance, are stored, said programs each being designed for device-type-specific communication between the at least one programmable input means and the control apparatus which is designed to activate only that program which corresponds to the type of domestic appliance which is connected to the input apparatus, on the basis of the type of domestic appliance where the input apparatus is connected to the control apparatus thereof.

In principle, the domestic appliance may be any conventional domestic appliance in a household if it has a functionality which goes beyond a simple switching-on and switching-off, in particular a programmable functionality. In particular, the domestic appliance may be an oven, a cooktop, a cooker hood, a dishwasher, a dryer, a washing machine or a refrigeration appliance.

The electrically actuated device-type-specific device component which is designed to execute an operating function which is characteristic of the type of domestic appliance may, for example in the case of an oven, be a heating device which is designed to heat an interior of the oven optionally to different temperatures. The device-type-specific device components may, for example in the case of a cooktop, be the individual hot plates or heating zones of the cooktop, which optionally may be switched on individually or in groups and operated at different heating levels. The device-type-specific device component of a cooker hood may be a fan which optionally produces an airflow at a lower or greater power in order to remove the steam produced during cooking. An exemplary device-type-specific device component of a dryer may also be a fan which permits a recirculating air operation in order to conduct a heated airflow over items of clothing to be dried inside the dryer. In the case of a dryer, however, the device-type-specific device component may also be a heating device which is configured to heat the airflow. In a washing machine, the device-type-specific device component may, for example, be the drive which is provided for rotating a washing drum of the washing machine. In the case of a refrigeration appliance as a domestic appliance, a compressor may be regarded as an important device-type-specific device component, which is part of a cooling circuit system which, for example, removes heat from a cooling chamber or a freezing chamber of the refrigeration appliance. In this regard, any type of domestic appliance may have, in particular, two or more device-type-specific device components. In such a case, two or more or all of the device components present in the respective domestic appliance may be operated together by the input apparatus.

The control apparatus of the domestic appliance is designed to actuate the device-type-specific device component. This means that each control apparatus is specifically configured according to the type of device for every type of domestic appliance and may be programmed individually in this regard, in particular fixedly, i.e. unchangeably, or may be constructed individually from different electrical and/or electronic components. However, the input apparatus is constructed identically for all types of domestic appliance. The control apparatus is, in particular, arranged in the interior of the respective domestic appliance and is neither visible to a user of the domestic appliance nor able to be operated by the user. The control apparatus is electrically connected to the input apparatus. In this regard, the input apparatus is configured and arranged separately from the control apparatus. Simply due to its function, the input apparatus is not concealed but is arranged so as to be visible to a user and able to be operated on the domestic appliance and fixedly connected thereto in the factory.

In addition to the control apparatus provided in the domestic appliance separately from the input apparatus, moreover, a control device, which is different from the control apparatus and which is arranged inside the input apparatus, is provided. The control device permits a device-type-specific communication between the at least one programmable input means of the input apparatus and the control apparatus of the domestic appliance. As differently configured programs are stored in the programmable control device which is configured for actuating a corresponding number of different types of domestic appliance, identical input apparatuses may be installed in separate and different types of domestic appliance.

An advantage in this case may be the saving of repeated deployment of operating hardware. The software development may be synchronized by the input apparatus which encompasses all types of device. Moreover, further savings may be anticipated due to the bulk purchase of electronic components and housing parts. Due to a brand-specific design of the hardware, i.e. the input apparatus, a single, in particular brand-specific, identity in terms of the operation and appearance thereof may be achieved across a plurality of domestic appliances. At the same time, it is possible to differentiate between brands across a plurality of products or product ranges in a cost-effective manner.

In the case of maintenance, the input apparatus, for example in the form of an electronic control module, may be relatively easily dismantled and replaced by a service technician. It is therefore possible for the repair times for the customer to be reduced and the control modules to be centrally repaired or sent for recycling.

Each program stored in the control device of the input apparatus is designed for device-type-specific communication between the at least one programmable input means and the control apparatus. The control device of the input apparatus is also designed to activate only that program which corresponds to the type of domestic appliance connected to the input apparatus, on the basis of the type of domestic appliance wherein the input apparatus is connected to the control apparatus thereof. In this regard, the control device automatically selects from a number of programs present in the input apparatus, of several different types of domestic appliance, that program which corresponds to the type of domestic appliance in which the input apparatus is installed in the factory.

The input apparatus may, in particular, be the only operating device which the domestic appliance comprises. In this regard, the domestic appliance may be configured to comprise exclusively this input apparatus in order to operate the domestic appliance. This also encompasses basic control switches and/or control buttons which according to the invention are integrated in the input apparatus, although they would not have to be configured differently for the different types of domestic appliance. By integrating at least one switch in the input apparatus, said switch being brought into electrical contact, basic functions of the domestic appliance which are characteristic of all types of appliance may be switched via the input apparatus, without separate additional device-specific switches being required. In this design of domestic appliance the different types of domestic appliance may then have an identical operating device encompassing all product types. Basic functions of the domestic appliance may, in principle, be implemented in an identical manner. The input apparatus has further programmable input means which by means of software, i.e. programs, may adapt the input apparatus to device-specific particularities. The input apparatus may optionally also be of modular construction. The input apparatus may, for example, be additionally provided with display means of variable size, in particular displays or touchscreens. Thus different levels of complexity may be represented and also class differentiations made. This may mean that by programming the control device of the input apparatus, different class structures may be provided, for example an input apparatus for cost-effective entry point domestic appliances and/or an input apparatus for premium domestic appliances with a different appearance and/or different functionalities for each device type class. Functions of the input apparatus may also be subsequently developed in terms of program technology, i.e. for example after delivery of the domestic appliance, during the period of use by the user, as required.

As the input apparatus, in addition to the at least one programmable input means, also has at least one switch which is brought into electrical contact in order to switch a basic function of the domestic appliance which is characteristic of all types of appliance, an input apparatus may be produced which is able to be used universally and which, on the one hand, may be adapted, i.e. configured, functionally in a very flexible manner to very different types of domestic appliance but, on the other hand, may also fulfill standardized functionalities or even standard functionalities which may apply to all types of domestic appliance.

In addition, the input apparatus may have electrical contacts which are connected to the at least one switch and which are electrically connected to counter-contacts of the domestic appliance when the input apparatus is mounted in the domestic appliance. As the input apparatus has electrical contacts and the domestic appliance and/or the basic device, which is different from the input apparatus, has corresponding counter-contacts, the at least one switch may be electrically connected without changing the structure. Thus, on the one hand, an electrically safe connection may be produced and, on the other hand, a safe input apparatus may be provided which reliably prevents an alteration, in particular a reprogramming, of these basic switches.

The at least one switch in the domestic appliance may be electrically connected such that by actuating the switch the domestic appliance is connected to the mains power supply and/or is disconnected from the mains power supply and/or a standby mode of the domestic appliance is activated and/or deactivated and/or a program-controlled operation of the domestic appliance is started and/or interrupted.

Thus the at least one switch in the domestic appliance, for example, may be electrically connected such that by actuating the switch the domestic appliance is connected to the mains power supply and/or is disconnected from the mains power supply. In this regard, the switch may be an on/off switch. The counter-contacts of the domestic appliance may thus be directly connected to electrical power cables and/or conducted to a mains power supply and/or may be brought into contact with a printed circuit board conducting a mains voltage.

The at least one switch in the domestic appliance, however, may also be electrically connected such that, for example, a standby mode of the domestic appliance is activated and/or deactivated or, for example, a program-controlled operation of the domestic appliance is started and/or interrupted. In this regard, such a switch may be a start/stop switch. In such a case the counter-contacts of the domestic appliance may be electrically connected to the control apparatus.

Generally, the input apparatus may be provided with a screen, wherein the at least one switch of the input apparatus is integrated in the screen and the input apparatus provided with the screen forms a subassembly which is fixedly installed in the domestic appliance. In this case, the input apparatus may be arranged together with the at least one switch on a common printed circuit board. This common printed circuit board may be connected to the screen.

The at least one switch may be integrated in a screen of the domestic appliance, said screen comprising fastening means which may be optionally fastened to counter-fastening means of different types of domestic appliance, encompassing different types of appliance, in order to mount the screen in the factory on one respectively selected domestic appliance of a specific type of domestic appliance. In this regard the fastening means and the counter-fastening means may be standardized across the different types of domestic appliance.

The at least one programmable input means may be a touchscreen and the control device may at the same time be designed, depending on the activated program, to configure one or more touch-sensitive buttons on the touchscreen corresponding to the type of domestic appliance connected to the input apparatus, for actuating the device-type-specific device component. The input apparatus, however, may also have one or more programmable buttons and/or switches, in particular separate from a touchscreen, and the control device may be designed, depending on the activated program, to configure the button(s) and/or switches corresponding to the type of domestic appliance connected to the input apparatus.

The programmable input means may generally form a plurality of programmable buttons and/or switches of the input apparatus separate from the display means. In this case, the control device may be designed to configure the input means corresponding to the type of domestic appliance connected to the input apparatus, depending on the activated program. Thus, for example, symbols or texts which display the respective function of the input means may be inserted in display sections of the display means spatially assigned to the input means. If the input apparatus, for example, is fixedly installed in the factory in a washing machine, the control device may be programmed such that a program stored in the control device may be activated for operating the washing machine, so that the input means, for example, are configured for activating different washing programs such as hot cycles, colors, delicates, etc. and at the same time, for example, the words "hot cycles", "colors", "delicates", etc. or corresponding symbols are shown in the spatially assigned display sections.

If, however, the input apparatus, for example, is fixedly installed in the factory in a cooker hood, the control device may be programmed such that a program stored in the control device may be activated for operating the cooker hood so that the input means, for example, are configured for selecting a plurality of different levels of fan power and at the same time, for example, the words "low" "medium" "high", etc. or corresponding symbols are shown in the spatially assigned display sections.

The input apparatus may have a touchscreen which is spatially assigned to one or more programmable buttons and/or switches and the control device may be configured, depending on the activated program, to show the button and/or switch configured according to the type of domestic appliance connected to the input apparatus and in each case to show a display on the touchscreen assigned to the configured function of the button and/or switch.

The at least one programmable input means may, however, also be a touchscreen itself, i.e. in this regard the display means itself. In this case, the control device may be designed, depending on the activated program, to configure one or more touch-sensitive buttons on the touchscreen corresponding to the type of domestic appliance connected to the input apparatus for actuating the device-type-specific device component. The touch-sensitive buttons thus configured may either replace the input means and correspondingly undertake the functions thereof or fulfill additional functions.

If the touch screen is the display means itself, then a plurality of these programmable buttons and/or switches of the input means may be spatially assigned to this touchscreen, wherein the control device may be configured, depending on the activated program, to show the button and/or switch of the input means configured according to the type of domestic appliance connected to the input apparatus and in each case to show a display on the spatially assigned display sections of the touchscreen assigned to the configured function of the button and/or the switch.

The programmable input means may be formed from a separate display or a portion of the display means, which visually represents functions configured according to the type of domestic appliance connected to the input apparatus, in particular also in the form of a menu structure, which may be selected and/or activated via one or more switching means, in particular at least one button, adjusting wheel or joystick.

The input apparatus may have at least one additional programmable input means which is fixedly programmed to switch a basic function of the domestic appliance which is characteristic of all types of device. For example, these buttons may be for activating a clock setting and/or for setting and starting a timer.

An exemplary embodiment of a domestic appliance according to the invention is described in more detail by way of example in the following description, with reference to the accompanying schematic drawings. Practical features of this exemplary embodiment may represent general features of the invention, optionally considered either individually or in combination, irrespective of the practical context in which they are mentioned.

DESCRIPTION OF THE INVENTION

Figure 1:
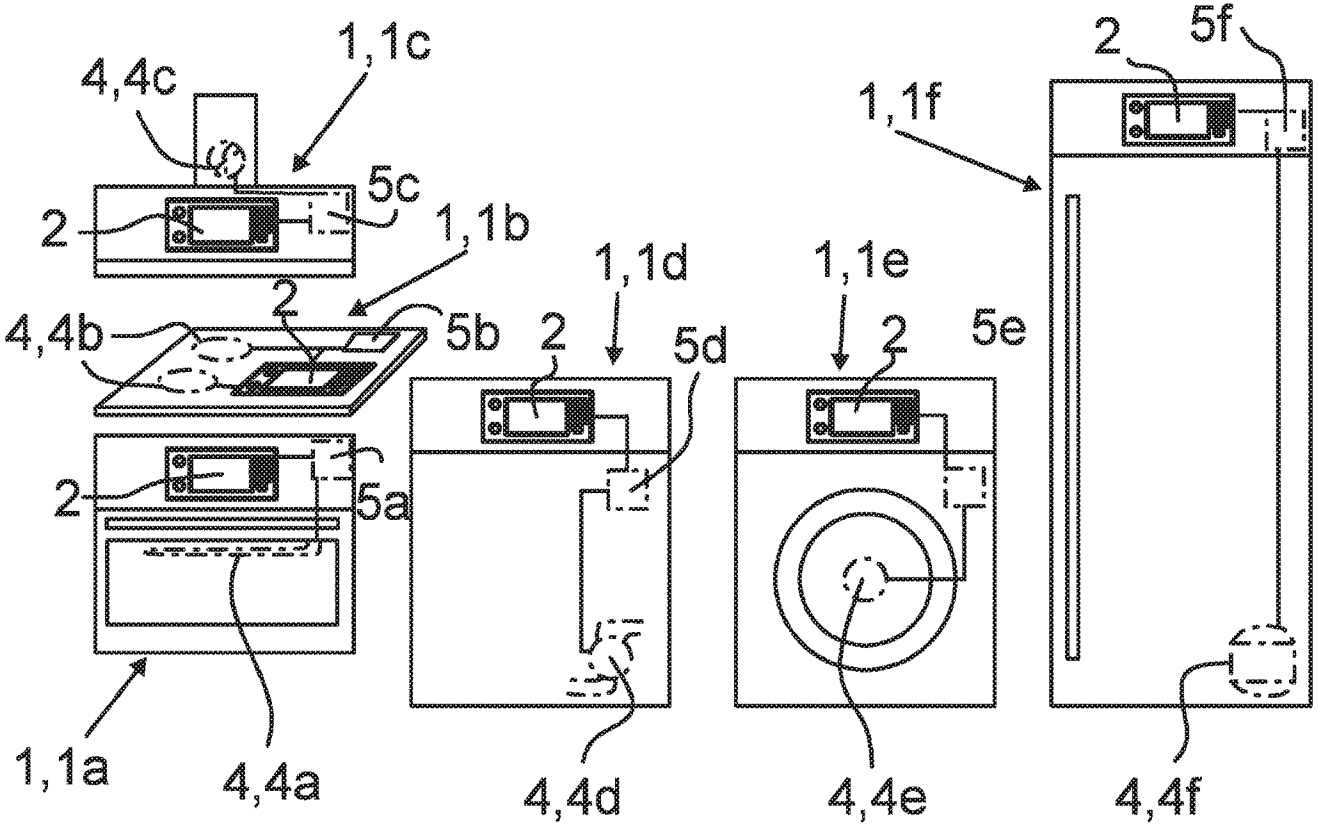
FIG. 1 shows a schematic view of different types of domestic appliance, each domestic appliance thereof comprising an input apparatus according to the invention.

In the example of an oven 1*a*, a cooktop 1*b*, a cooker hood 1*c*, a dryer 1*d*, a washing machine 1*e* and a refrigeration appliance 1*f*, the schematic view shown in FIG. 1 of different types of domestic appliance 1 represents an operating concept which encompasses the product range and which at the same time may also represent brand-specific designs. An input apparatus 2 according to the invention forms a control module which has identical hardware for all types of domestic appliance 1 and which may have an identical interface in all types of domestic appliance 1, the input apparatus 2 being able to be connected to the respective domestic appliance 1 via said interface. The device-specific parameters may be reproduced by software in an electronic unit. Such an electronic unit may form a programmable control device 3 which is part of the input apparatus 2.

Each of the domestic appliances 1*a* to 1*f* has at least one electrically actuated device-type-specific device component 4, 4*a* to 4*f* which is configured to execute an operating function which is characteristic of the type of domestic appliance 1*a* to 1*f*. By way of example in FIG. 1*a* representative device component 4*a* to 4*f* is shown for each type of domestic appliance 1*a* to 1*f*. Each type of domestic appliance 1*a* to 1*f* may, however, also comprise two or more device-type-specific device components. In such a case, two or more or all of the device components present may be operated together by the input apparatus 2. The device-type-specific device component 4*a* of the oven 1*a* is by way of example a heating device which is designed for heating an interior of the oven 1*a* optionally at different temperatures. The device-type-specific device components 4*b* of the cooktop 1*b* are the individual hot plates or heating zones of the cooktop 1*b* which optionally may be switched on and operated individually or in groups and at different heating levels. The device-type-specific device component 4*c* of the cooker hood 1*c* is a fan which produces an airflow optionally at lower or greater power in order to remove steam produced when cooking. An exemplary device-type-specific device component 4*d* of the dryer 1*d* may also be a fan which permits a circulating air operation in order to conduct a heated airflow over items of clothing to be dried inside the dryer 1*d*. In the washing machine 1*e* shown, the exemplary device-type-specific device component 4*e* is the drive which is provided for rotating a washing drum of the washing machine 1*e*. In the case of a refrigeration appliance if as a domestic appliance 1, a condenser may be considered as an important device-type-specific device component 4*f* which is part of the cooling circuit system which, for example, removes heat from a cooling chamber or a freezing chamber of the refrigeration appliance 1*f*.

Each domestic appliance 1*a* to if has a device-type-specific control apparatus 5*a* to 5*f* which in each case is configured to actuate the device-type-specific device component 4*a* to 4*f* This means that each device-type-specific control apparatus 5*a* to 5*f* is individually configured for each type of domestic appliance 1*a* to 1*f* However, the input apparatus 2 is identically constructed for all types of domestic appliance 1*a* to 1*f*. The control apparatus 5*a* to 5*f* is arranged in the interior of the respective domestic appliance 1*a* to if and is neither visible to a user of the domestic appliance 1*a* to if nor able to be operated by the user. The control apparatuses 5*a* to 5*f* are in each case electrically connected to an associated input apparatus 2. In this regard, the input apparatus 2 is configured and arranged separately from the respective control apparatus 5*a* to 5*f*. Simply due to its function, the input apparatus 2 is not concealed but arranged to be visible to a user and able to be operated on the domestic appliance 1*a* to 1*f* and fixedly connected thereto in the factory.

In this regard the input apparatus 2, which also comprises the programmable control device 3, forms a control module which may be docked via a suitable interface, encompassing the product range, to different domestic appliances. In terms of hardware, the control module contains all of the necessary controls, buttons and display elements which are required for controlling/operating the respective domestic appliance 1, 1*a* to 1*f*. Optionally, in order to be able to represent the effects of scale in terms of operation and display, the control module may in turn be of modular construction. The connection to the domestic appliance 1, 1*a* to if is made in the factory by a suitable plug connection and securing takes place by a suitable mounting element such as a screw or similar fastening means. An electrical contact may either be made via the plug connection or separately via a cable plug connection. The control module is modified by different types of software for controlling the different domestic appliances 1*a* to 1*f* To this end, the control module contains a standard interface for data transmission. The hardware is identical, irrespective of the product.

Figure 2:
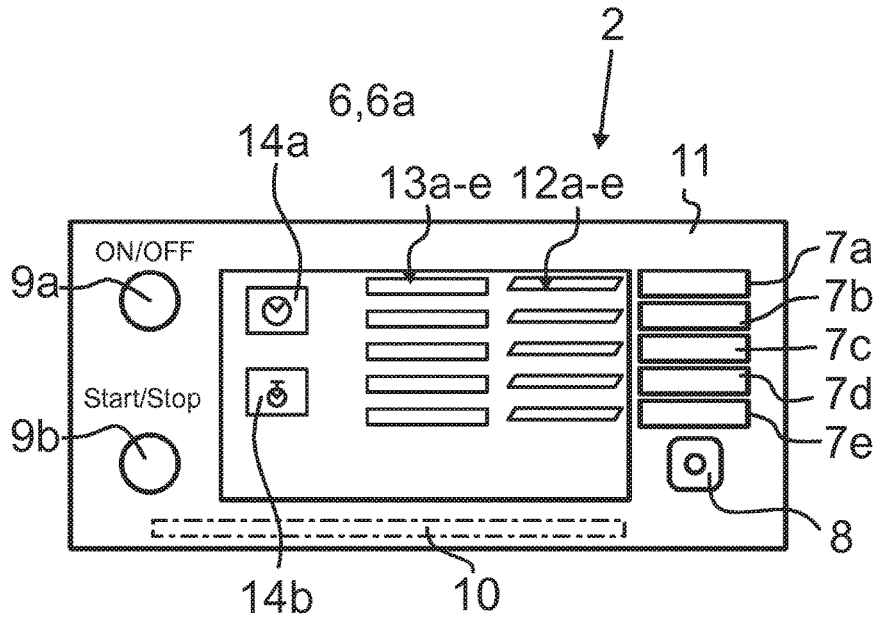
FIG. 2 shows a schematic view solely of an input apparatus according to the invention.

FIG. 2 shows the input apparatus 2 alone. The input apparatus 2 in the case of the exemplary embodiment shown has a display means 6, five programmable input means 7*a* to 7*e*, a joystick 8, as well as two switches 9*a* and 9*b*. Each of the two switches 9*a* and 9*b* is brought into electrical contact in order to switch a basic function of the domestic appliance 1*a* to if which is characteristic of all device types. In the case of the present exemplary embodiment, the upper switch 9*a* in the domestic appliance 1, for example, is electrically connected such that by actuating the switch 9*a* the domestic appliance 1 is connected to the mains power supply and/or is disconnected from the mains power supply. The switch 9*a* is, therefore, in this regard an on/off switch. In the case of the present exemplary embodiment, however, the lower switch 9*a* in the domestic appliance 1 is electrically connected such that, for example, a standby mode of the domestic appliance 1 is activated and/or deactivated or, for example, a program-controlled operation of the domestic appliance 1 is started and/or interrupted. In this regard, the switch 9*b* is, therefore, a start/stop switch.

The input apparatus 2 also has a programmable control device 10 not generally visible from outside and therefore shown in dotted lines. In the control device 10 at least two differently configured programs are stored for activating a corresponding number of different types of domestic appliance 1*a* to if which in each case are designed for device-type-specific communication between the programmable input means 7*a* to 7*e* and the respective control apparatus 5*a* to 5*f*. The input apparatus 2 in this case is designed to activate only that program which corresponds to the type of domestic appliance 1*a* to if connected to the input apparatus 2, as shown in FIG. 1, on the basis of the type of domestic appliance 1*a* to 1*f* where the input apparatus 2 is connected to the respective control apparatus 5*a* to 5*f* thereof.

In the exemplary embodiment shown in FIG. 2, the switches 9*a* and 9*b*, the programmable input means 7*a* to 7*e*, the joystick 8 and the display means 6 are integrated in a screen 11 which together with the input apparatus 2 forms a subassembly fixedly installed in the respective domestic appliance 1*a* to 1*f*.

The programmable input means 7*a* to 7*e* form, in the case of the exemplary embodiment shown, a plurality of programmable buttons and/or switches of the input apparatus 2 separate from the display means 6. In this case, the control device 10 is designed to configure, depending on the activated program, the input means 7*a* to 7*e* corresponding to the type of domestic appliance 1*a* to 1*f* connected to the input apparatus 2. Thus, for example, symbols or texts which display the respective function of the input means 7*a* to 7*e* are incorporated in display sections 12*a* to 12*e* of the display means 6 spatially assigned to the input means 7*a* to 7*e*. If the input apparatus 2 shown in FIG. 2, for example, has been fixedly installed in the factory in a washing machine 1*e*, the control device 10 may be programmed such that a program stored in the control device 10 for operating the washing machine 1*e* may be activated so that the input means 7*a* to 7*e*, for example, are configured to activate different washing programs, such as hot cycles, colors, delicates, etc. and at the same time, for example, the words "hot cycles", "colors", "delicates", etc. or corresponding symbols are shown in the spatially assigned display sections 12*a* to 12*e*. In this case, each of the two switches 9*a* and 9*b* remains electrically in contact in order to switch the respective basic function of the domestic appliance 1*a* to if which is characteristic of all device types.

If, however, the input apparatus 2 has been fixedly installed in the factory in a cooker hood 1*c*, for example, the control device 10 may be programmed such that a program stored in the control device 10 may be activated for operating the cooker hood 1*c* so that the input means 7*a* to 7*e*, for example, are configured for selecting a plurality of different levels of fan power and at the same time, for example, the words "low" "medium" "high", etc. or corresponding symbols are shown in the spatially assigned display sections 12*a* to 12*e*. Also, in this case each of the two switches 9*a* and 9*b* remains electrically in contact in order to switch the respective basic function of the domestic appliance 1*a* to if which is characteristic of all device types.

The at least one programmable input means 7 may, however, also be a touchscreen 6*a*, i.e. in this regard the display means 6 itself. In this case, the control device 10 is designed according to the activated program to configure one or more touch-sensitive buttons 13*a* to 13*e* on the touchscreen 6*a* corresponding to the type of domestic appliance 1*a* to 1*f* connected to the input apparatus 2 for activating the device-type-specific device component. The touch-sensitive buttons 13*a* to 13*e* configured in this manner may either replace the input means 7*a* to 7*e* and accordingly undertake the functions thereof or fulfill additional functions. Also, in this case each of the two switches 9*a* and 9*b* remains electrically in contact in order to switch the respective basic function of the domestic appliance 1*a* to if which is characteristic of all device types.

If the touch screen 6*a* is the display means 6 itself, then a plurality of these programmable buttons and/or switches of the input means 7*a* to 7*e* may be spatially assigned to the touchscreen 6*a*, wherein the control device 10 is configured, depending on the activated program, to show the button and/or switch of the input means 7*a* to 7*e* configured according to the type of domestic appliance 1*a* to 1*f* connected to the input apparatus 2, and in each case to show a display on the spatially assigned display sections 12*a* to 12*e* of the touchscreen 6*a* assigned to the configured function of the button and/or the switch.

The programmable input means 7*a* to 7*e* may be formed from a separate display or, as shown in FIG. 2, from a portion of the display means 6, which visually shows functions configured according to the type of domestic appliance 1*a* to 1*f* connected to the input apparatus 2, in particular in the form of a menu structure, said functions being able to be selected and activated via one or more switching means, in particular at least one button, adjusting wheel and/or the joystick 8.

In the case of the present exemplary embodiment of FIG. 2, the input apparatus 2 comprises two additional programmable input means 14*a* and 14*b* which are fixedly programmed for switching a basic function of the domestic appliance 1 which is characteristic of all device types. By way of example, in the input means 14*a* these basic functions are the activation of a clock setting and in the input means 14*b* the setting and starting of a timer.

LIST OF REFERENCE NUMERALS

1 Domestic appliance
1*a* Oven
1*b* Cooktop
1*c* Extractor hood
1*d* Dryer
1*e* Washing machine
1*f* Refrigeration appliance
2 Input apparatus
3 Programmable control device
4*a*-4*f* Device-type-specific device component
5*a*-5*f* Control apparatus
6 Display means
6*a* Touchscreen
7*a*-7*e* Programmable input means
8 Joystick
9*a*, 9*b* Switch
10 Control device
11 Screen
12*a*-12*e* Display sections
13*a*-13*e* Touch-sensitive buttons
14*a*, 14*b* Input means

The invention claimed is:

1. A domestic appliance, comprising:
counter-contacts;
at least one electrically actuated device-type-specific device component configured to execute an operating function being characteristic of a type of domestic appliance;
a control apparatus configured to actuate said device-type-specific device component; and
an input apparatus fixedly installed in, and integrated into, the domestic appliance, the input apparatus electrically connected to said control apparatus, said input apparatus including:
a display,
at least one programmable input device,
at least one switch being electrically contacted to switch a basic function of the domestic appliance, said basic function being characteristic of at least two different types of domestic appliance,
electrical contacts connected to said at least one switch and electrically connected to said counter-contacts upon mounting said input apparatus in the domestic appliance, such that actuation of said switch directly connects said counter-contacts to a part of the domestic appliance to perform said basic function,
a programmable control device storing at least two programs being differently configured to actuate a corresponding number of different types of domestic appliance,
said programs each being configured for device-type-specific communication between said at least one programmable input apparatus and said control apparatus, and
said programmable control device being configured to activate only that program corresponding to the type of domestic appliance fixedly connected to said input apparatus, based on the type of domestic appliance having said control apparatus thereof connected to said input apparatus.

2. The domestic appliance according to claim 1, wherein said at least one switch is electrically connected and is actuatable for at least one of:
connecting the domestic appliance to a mains power supply or
disconnecting the domestic appliance from the mains power supply or
activating a standby mode of the domestic appliance or
deactivating the standby mode of the domestic appliance or
starting a program-controlled operation of the domestic appliance or
interrupting the program-controlled operation of the domestic appliance.

3. The domestic appliance according to claim 1, wherein said input apparatus has a screen, said at least one switch of said input apparatus is integrated in said screen, and said input apparatus provided with said screen forms a subassembly fixedly installed in the domestic appliance.

4. The domestic appliance according to claim 1, which further comprises a screen, said at least one switch being integrated in said screen, and said screen including a fastener configured to be optionally fastened to counter-fasteners of different types of domestic appliance, in order to mount said screen in a factory on one respectively selected domestic appliance of a specific type of domestic appliance.

5. The domestic appliance according to claim 1, wherein:
said at least one programmable input device is a touch screen having at least one touch-sensitive button corresponding to the type of domestic appliance connected to said input apparatus; and said control device is configured, depending on said activated program, to configure said at least one touch-sensitive button for actuating said at least one device-type-specific device component.

6. The domestic appliance according to claim 1, wherein said input apparatus has at least one of one or more programmable buttons or one or more switches, and said control device is configured, depending on said activated program, to configure said at least one of buttons or switches corresponding to the type of domestic appliance connected to said input apparatus.

7. The domestic appliance according to claim 6, wherein said input apparatus has a touch screen being separate from said programmable buttons or switches.

8. The domestic appliance according to claim 6, wherein said input apparatus has a touch screen being spatially associated with at least one of said programmable buttons or switches, and said control device is configured, depending on said activated program, to show a button or switch configured according to the type of domestic appliance connected to said input apparatus and to show a display on said touch screen associated with a configured function of said button or switch.

9. The domestic appliance according to claim 1, which further comprises at least one other switch, said at least one programmable input device being formed as a portion of said display or as a separate display visually representing functions configured according to the type of domestic appliance connected to said input apparatus and configured to be selected and activated by said at least one other switch.

10. The domestic appliance according to claim 9, wherein said visually represented functions are formed as a menu structure.

11. The domestic appliance according to claim 9, wherein said at least one other switch is at least one button, adjusting wheel or joystick.

12. The domestic appliance according to claim 1, wherein said input apparatus has at least one additional programmable input device being fixedly programmed to switch a basic function of the domestic appliance being characteristic of all types of device.

13. The domestic appliance according to claim 1, wherein the domestic appliance is an oven, a cook top, a cooker hood, a dishwasher, a dryer, a washing machine or a refrigeration appliance.

* * * * *